US006352199B1

(12) United States Patent
Gardner

(10) Patent No.: US 6,352,199 B1
(45) Date of Patent: Mar. 5, 2002

(54) THREE-PIECE CORRUGATED PAPERBOARD CONTAINER

(75) Inventor: Jeffrey M. Gardner, West Chicago, IL (US)

(73) Assignee: Weyerhauser Company, Federal Way, WA (US)

( * ) Notice: Subject to any disclaimer, the term of this patent is extended or adjusted under 35 U.S.C. 154(b) by 0 days.

(21) Appl. No.: 09/847,818

(22) Filed: May 1, 2001

Related U.S. Application Data

(60) Provisional application No. 60/200,949, filed on May 1, 2000.

(51) Int. Cl.[7] ..... B65D 5/32

(52) U.S. Cl. ..... 229/122.26; 229/122.24; 229/143

(58) Field of Search ..... 229/122.24, 122.26, 229/143, 915, 918, 919

(56) References Cited

U.S. PATENT DOCUMENTS

| | | | | |
|---|---|---|---|---|
| 1,372,809 A | | 3/1921 | Gross | |
| 1,974,527 A | | 9/1934 | Bliss | |
| 2,606,709 A | | 8/1952 | Carey et al. | |
| 2,984,402 A | | 5/1961 | Putnam | |
| 3,048,318 A | | 8/1962 | Sabin | |
| 3,099,379 A | | 7/1963 | Stease | |
| 3,214,076 A | | 10/1965 | Gagnon | |
| 3,348,667 A | | 10/1967 | Beeby | |
| 3,863,831 A | * | 2/1975 | Wozniacki et al. | 229/122.26 |
| 3,899,123 A | * | 8/1975 | Stollberg et al. | 229/122.26 |
| 3,905,541 A | | 9/1975 | Paxton | |
| 3,921,893 A | | 11/1975 | Randle, Jr. | |
| 3,993,239 A | | 11/1976 | Exel | |
| 4,120,443 A | | 10/1978 | Gardner et al. | |
| 4,127,304 A | | 11/1978 | Gardner | |
| 4,194,678 A | | 3/1980 | Jasper | |
| 4,197,789 A | | 4/1980 | Moen | |
| 4,220,076 A | | 9/1980 | Moen | |
| 4,282,999 A | | 8/1981 | Moen | |
| 4,283,188 A | | 8/1981 | Wingerter et al. | |
| 4,303,405 A | | 12/1981 | Reichert | |
| 4,310,323 A | | 1/1982 | Moen | |
| 4,333,600 A | | 6/1982 | Gardner | |
| 4,376,507 A | | 3/1983 | Nauheimer | |
| 4,398,901 A | | 8/1983 | Campbell | |
| 4,497,408 A | * | 2/1985 | Jes | 229/122.24 |
| 4,581,005 A | | 4/1986 | Moen | |
| 4,601,687 A | | 7/1986 | Gallaher | |
| 4,657,527 A | | 4/1987 | Moen | |
| 4,779,737 A | * | 10/1988 | Umehara et al. | 229/122.26 |
| 4,793,494 A | | 12/1988 | Gordon, Jr. | |
| 4,850,948 A | | 7/1989 | Schmitz | |

(List continued on next page.)

OTHER PUBLICATIONS

U.S. Application No. 09/797,997, filed Mar. 2, 2001, Jeffrey M. Gardner.
U.S. Application No. 09/847,817, filed May 1, 2001, Jeffrey M. Gardner et al.

*Primary Examiner*—Gary E. Elkins
(74) *Attorney, Agent, or Firm*—Christensen O'Connor Johnson Kindness PLLC

(57) ABSTRACT

A bliss-style container is provided having a single outer member (10) and first and second separate inner members (12). The outer member (10) includes a bottom panel (14), two primary end panels (16), and two upright reinforcing flaps. Each primary end panel (16) includes two upright reinforcing side flaps (20). The first and second inner members (12) each include an upright side panel (22) and first and second secondary end panels (24) hingedly connected to opposed side panel side edges. Each secondary end panel (24) has an outer edge (26). As assembled, both sets of secondary end panels (24) are positioned so that their outer edges are within a distance of less than about 0.25 inches of one another.

8 Claims, 8 Drawing Sheets

U.S. PATENT DOCUMENTS

| | | | | |
|---|---|---|---|---|
| 4,955,502 | A | | 9/1990 | Sorci |
| 5,143,278 | A | | 9/1992 | Petriekis et al. |
| 5,316,210 | A | | 5/1994 | Scullin |
| 5,333,777 | A | | 8/1994 | Roth |
| 5,335,844 | A | | 8/1994 | Young |
| 5,419,485 | A | | 5/1995 | Petriekis et al. |
| 5,520,325 | A | | 5/1996 | Quaintance |
| 5,597,111 | A | * | 1/1997 | MacKinnon et al. ..... 229/919 |
| 5,950,915 | A | | 9/1999 | Moen |
| 5,967,406 | A | | 10/1999 | Moorman |
| 5,975,413 | A | | 11/1999 | Moen |

* cited by examiner

THREE-PIECE CORRUGATED PAPERBOARD CONTAINER

CROSS-REFERENCE TO RELATED APPLICATION

This application claims priority to U.S. Provisional Application No. 60/200,949 filed May 1, 2000, the priority benefit to which is hereby claimed under 35 U.S.C. 119(e).

FIELD OF THE INVENTION

The present invention relates to corrugated paperboard shipping and display containers, and more particularly, to bliss-style containers having an inner liner and an outer body wrap, configured to attain high strength while economizing on the amount of material used in its formation.

BACKGROUND OF THE INVENTION

Various types of bliss containers are known. In general, a bliss container includes at least one inner member (or liner) and an outer member (also called a body wrap or tray) adhered about the inner portion. Bliss containers offer many advantages, most notably that they are stronger than most containers due to their having double- and triple-wall thicknesses. This makes bliss containers particularly advantageous for shipping purposes.

See for example, U.S. Pat. No. 3,099,379 in which bliss-style shipping containers are described. Such containers are generally constructed of a single outer portion and two inner portions. In the '379 patent, each inner portion includes an end panel (32) with opposed side reinforcement flaps (34) and (36). The reinforcement flaps provide reinforcement at the container's comers. This is not always adequate, however, in all shipping applications.

Designers have attempted to increase the reinforcement of the container's side walls by configuring an inner portion with plural foldable inner flaps (see for example U.S. Pat. No. 4,197,789) or by using offset inner side walls. See for example, the container of U.S. Pat. No. 5,975,413 in which two separate inner portions are used to extend along the side and end wall areas, the inner portions being positioned to abut edges at the container inner comers. Some arrangements use double wall thicknesses having two fluted layers interspersed between three liners. While the '789 and '413 arrangements offer two-ply side wall thicknesses, they are wasteful in their construction (especially if a lid is desired) and they are not suitable for all shipping purposes. Thus, a need yet exists for a bliss-style container having an easily manufactured side wall of at least double-ply thickness in order to improve the container's strength and stacking capability. The present invention is directed to fulfilling this need and others as described below.

SUMMARY OF THE INVENTION

In accordance with the teachings of the present inventions, a generally rectangular container is provided including a single outer member and first and second separate inner members. The outer member includes a bottom panel, two primary end panels connected to the bottom panel, and two reinforcing side flaps connected to opposed bottom panel side edges. Each primary end panel has two upright reinforcing side flaps and an interior surface. The inner members each include an upright side panel and first and second secondary end panels connected to opposed side panel side edges. Each secondary end panel has an outer edge.

As assembled, the inner members are located within the outer member. One reinforcing flap of the bottom panel and two opposed upright side reinforcing flaps of the primary end panels form a U-shaped side wall support along the exterior surface of each inner member upright side panel. The secondary end panels of the inner members are located adjacent the interior surfaces of the primary end panels. The secondary end panels are sized so that their outer edges are positioned within a distance of less than about 0.25 inches of one another.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention is a three-piece bliss-style container having two inner members and a single outer member. Each member is formed of a single-ply paperboard material, i.e., those having a fluted material positioned between two liners or the like. To assemble the container, the inner members are formed and then the outer member is formed about the inner members. The outer member is preferably adhered to the inner members during formation of the outer member so that the container remains a unitary object throughout its use. The inner members are sized so that their exposed edges are abutting or nearly abutting as assembled. FIGS. 1–4 illustrate a first embodiment of a container so formed; FIGS. 5–8 illustrate a second embodiment.

Figure 2:
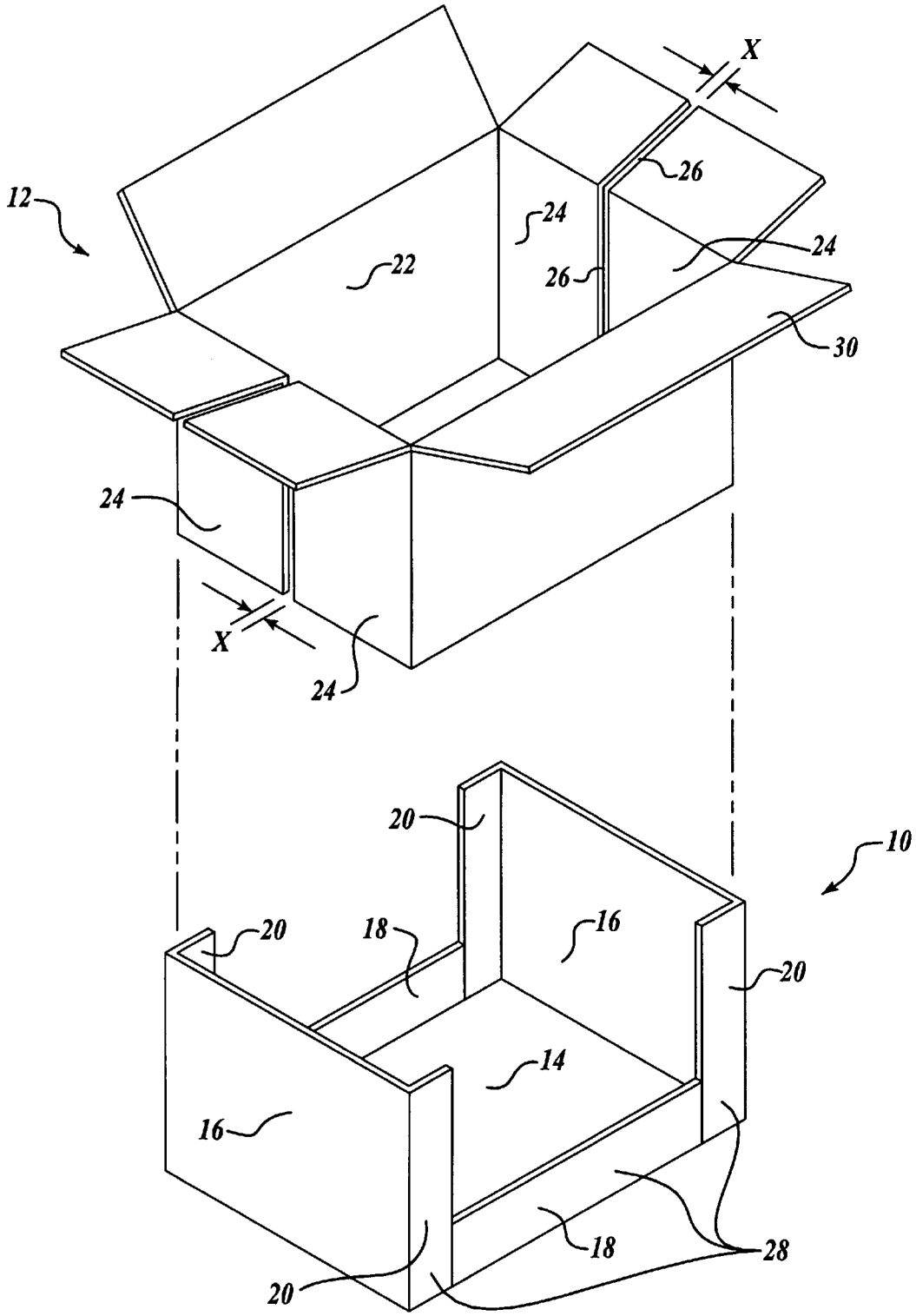
FIG. 2 is an exploded orthogonal view of the container of FIG. 1.

Referring to FIG. 2, a container formed in accordance with the present invention includes an outer member 10 and first and second separate inner members 12. As shown best in FIG. 3, the outer member 10 includes a lateral bottom panel 14, two primary end panels 16 hingedly connected to opposed bottom panel end edges, and two reinforcing side flaps 18 hingedly connected to opposed bottom panel side edges. Each primary end panel 16 also includes two upright reinforcing side flaps 20 hingedly connected to opposed side edges of the primary end panel 16. Each primary end panel 16 further includes an interior surface.

Figure 4:
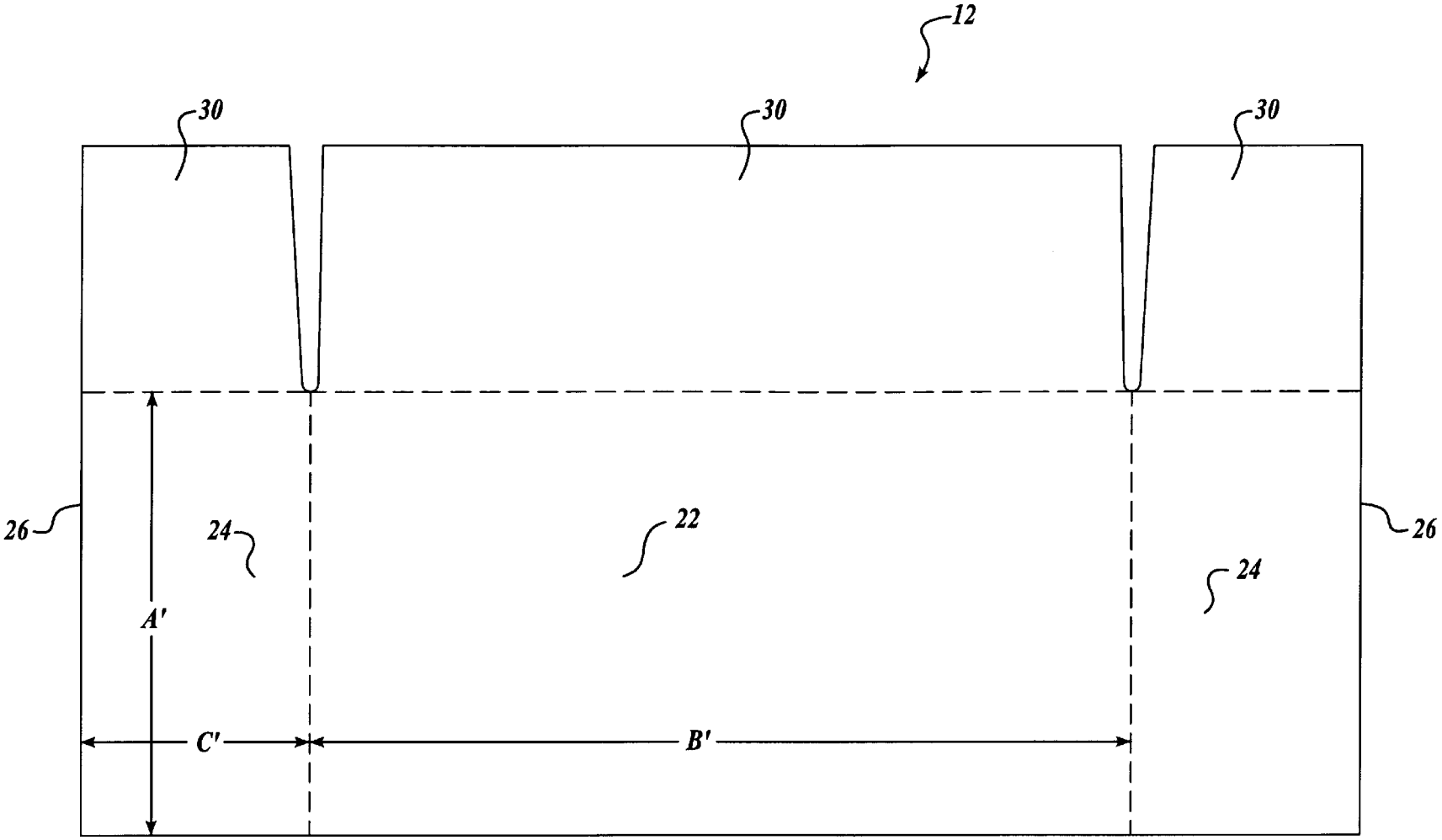
FIG. 4 is a plan view of an inner member blank used in the container of FIG. 1.
Figure 5:
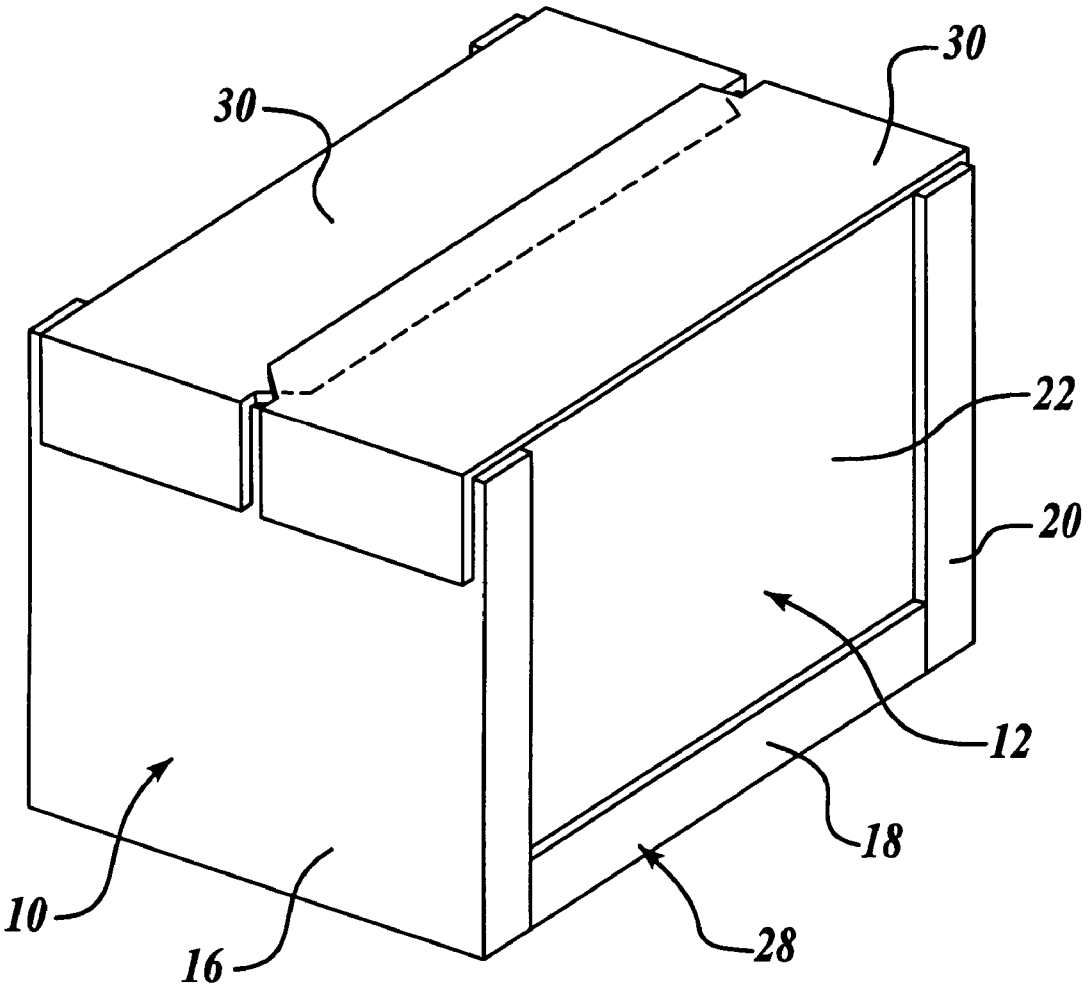
FIG. 5 is an orthogonal view of a second embodiment of a container formed in accordance with the present invention.
Figure 6:
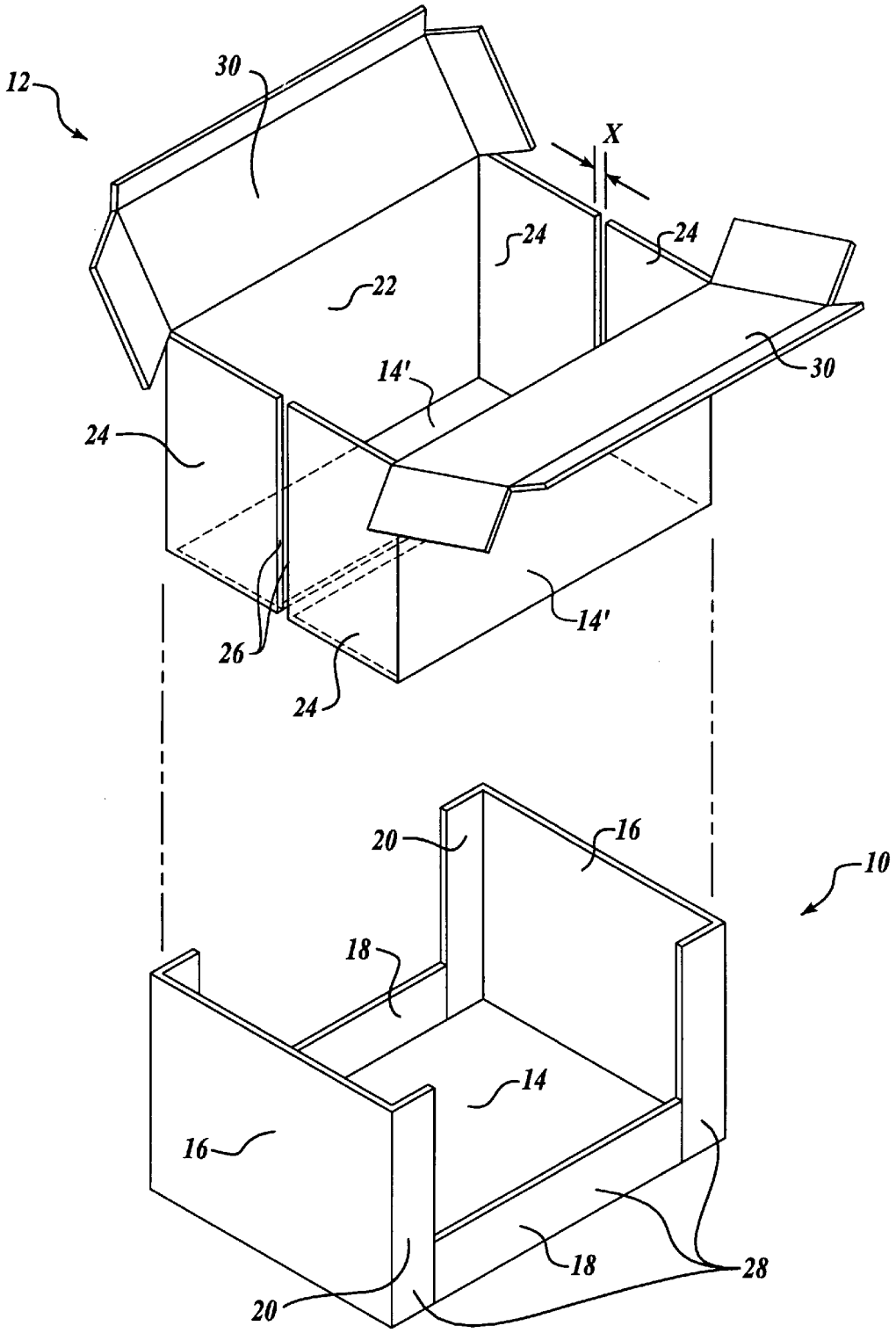
FIG. 6 is an exploded orthogonal view of the container of FIG. 5, showing also optional secondary bottom panels in phantom.
Figure 7:
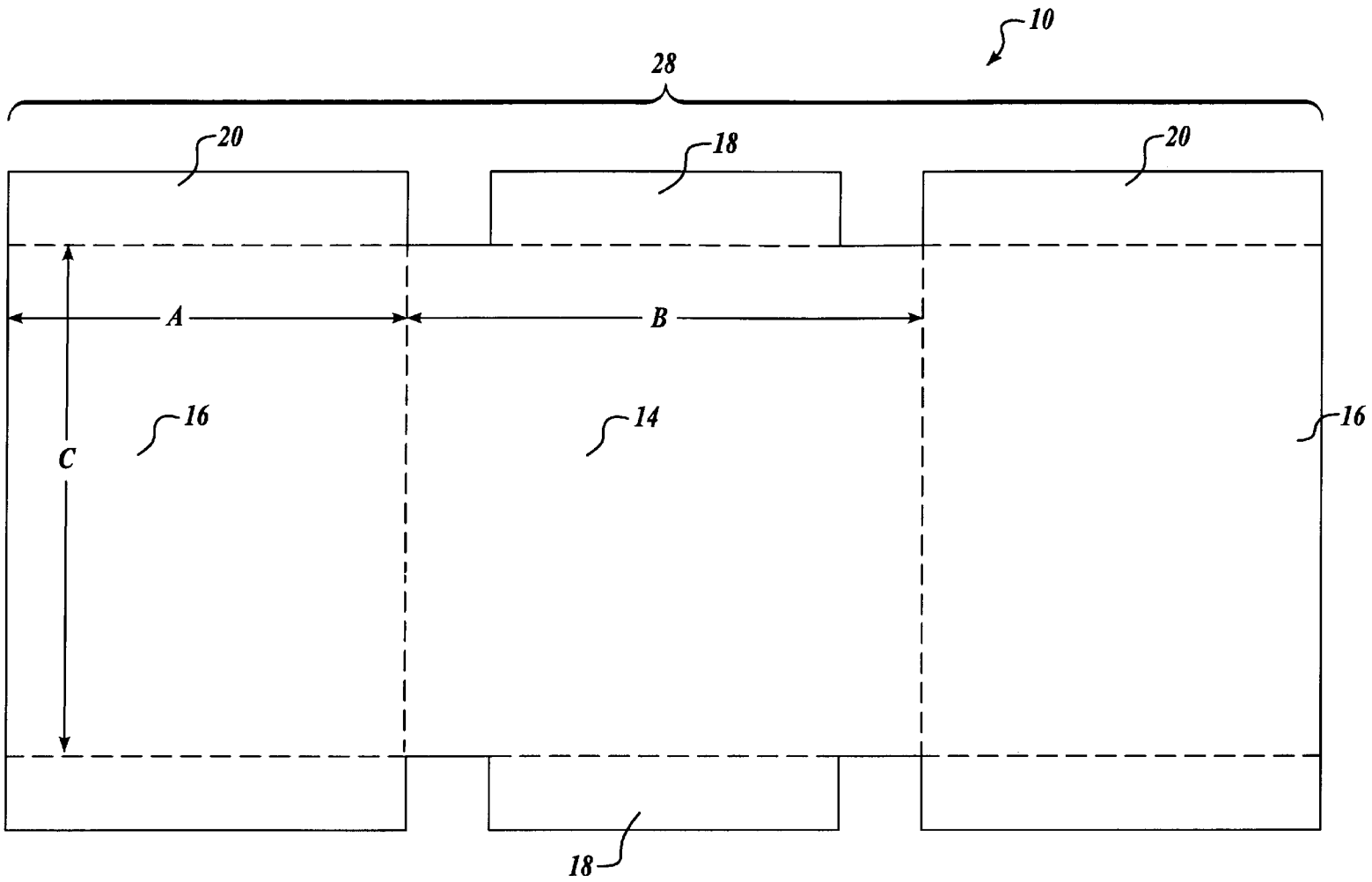
FIG. 7 is a plan view of an outer member blank used in the container of FIG. 5.
Figure 8:
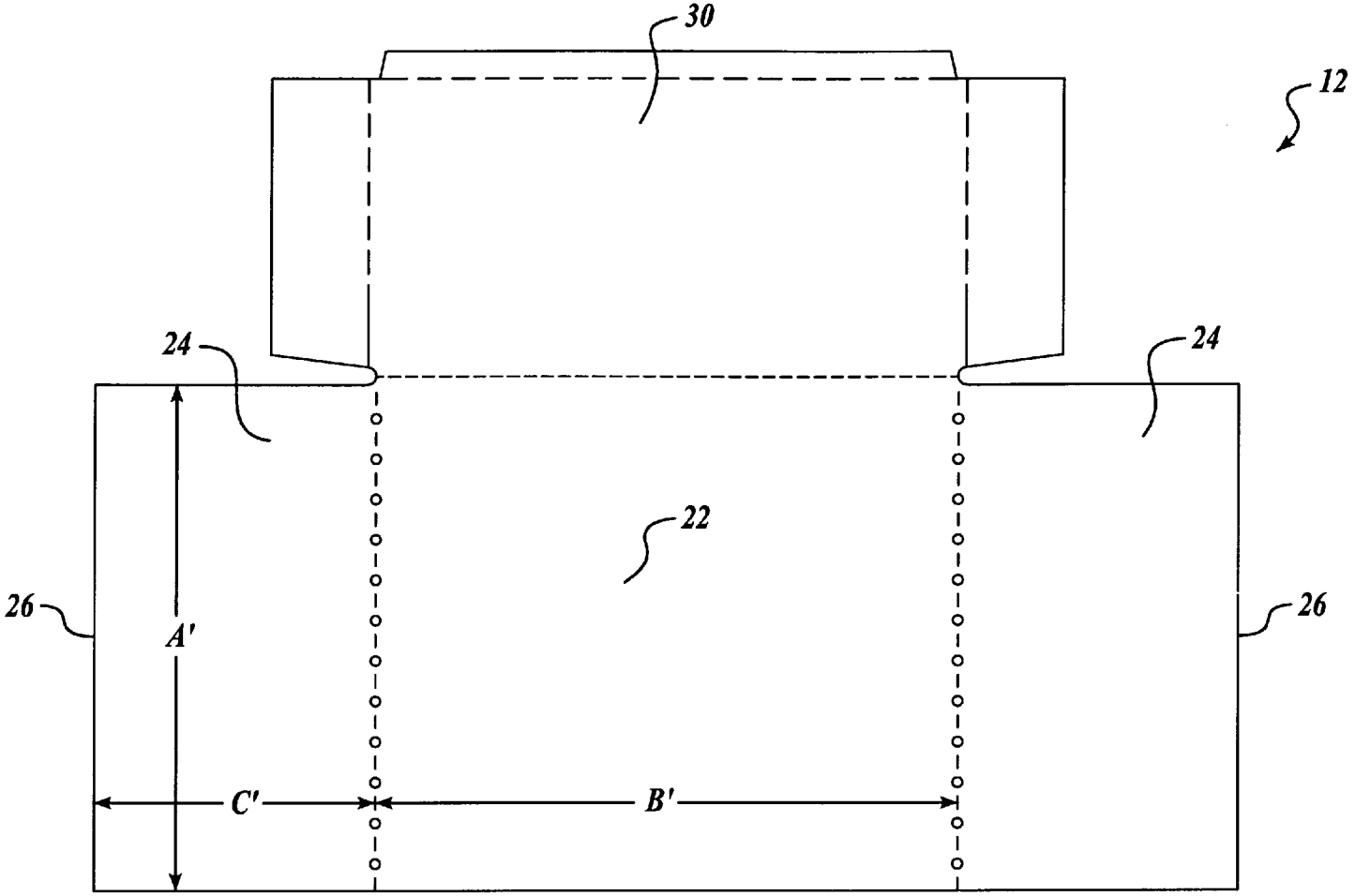
FIG. 8 is a plan view of inner member blanks used in the container of FIG. 5.

FIG. 4 is a plan view of the inner member 12 used in FIG. 2. In general, the first and second inner members 12 are of the same size and configuration. Each inner member 12 includes an upright side panel 22 and first and second secondary end panels 24 hingedly connected to opposed side edges of the side panel 22. Each secondary end panel 24 has an outer edge 26. In one embodiment, each inner member 12 further includes a bottom flap 14' hingedly connected to the lower edge of its upright side panel 22. See the phantom lines of FIG. 6.

Figure 1:
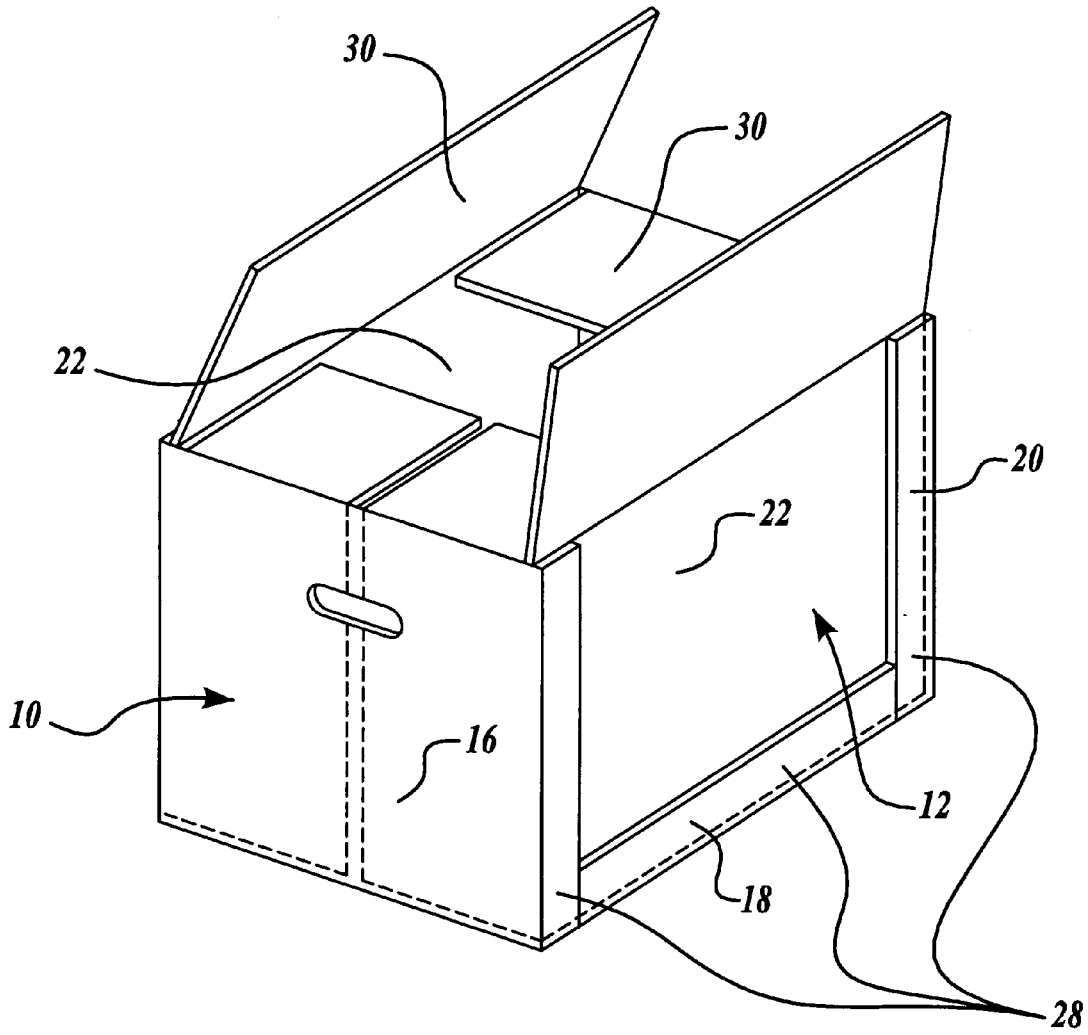
FIG. 1 is an orthogonal view of a first embodiment of a container formed in accordance with the present invention.

As assembled and shown in FIG. 1, the inner members 12 are located opposite one another, within the outer member 10. One upright reinforcing side flap 18 and two opposed upright reinforcing side flaps 20 form a U-shaped side wall support 28 along the exterior surface of each inner member upright side panel 22. The components of the U-shaped side wall support 28 are preferably coplanar with one another and are preferably adhesively attached to the exterior surface of the inner member upright side panels 22.

The first secondary end panels of the inner members are located adjacent one of the primary end panel interior surfaces. The second secondary end panels are located adjacent the other of the primary end panel interior surfaces. Both sets of secondary end panels are sized so that their outer edges are positioned within a distance of less than about 0.25 inches of one another. See the distance labeled X in FIG. 2. Alternatively, they may be sized to abut one another. In one embodiment, they are a distance of less than about 0.125 inches. In another embodiment, they are a distance of less than about 0.5 inches. An adhesive is preferably used between the primary and secondary walls surfaces to help the secondary end panels to maintain their close relationship.

The container is preferably formed of corrugated cardboard material comprising a fluted medium. When the inner and outer members are erected, their side wall flutes are vertically oriented. One or more of the various panels are double laminated to improve top to bottom container strength.

The container may be erected by laying the outer member 10 horizontally and placing glue on select outer member interior surfaces. The inner members 12 are folded and placed opposite one another on top of the bottom panel 14 of the outer member 10. The primary end walls 16 of the outer member 10 are folded upward and the various reinforcing flaps 18, 20 are folded inward. Thus, the inner members 12 are internal to the outer member 10, with the outer member acting as a body wrap.

Figure 3:
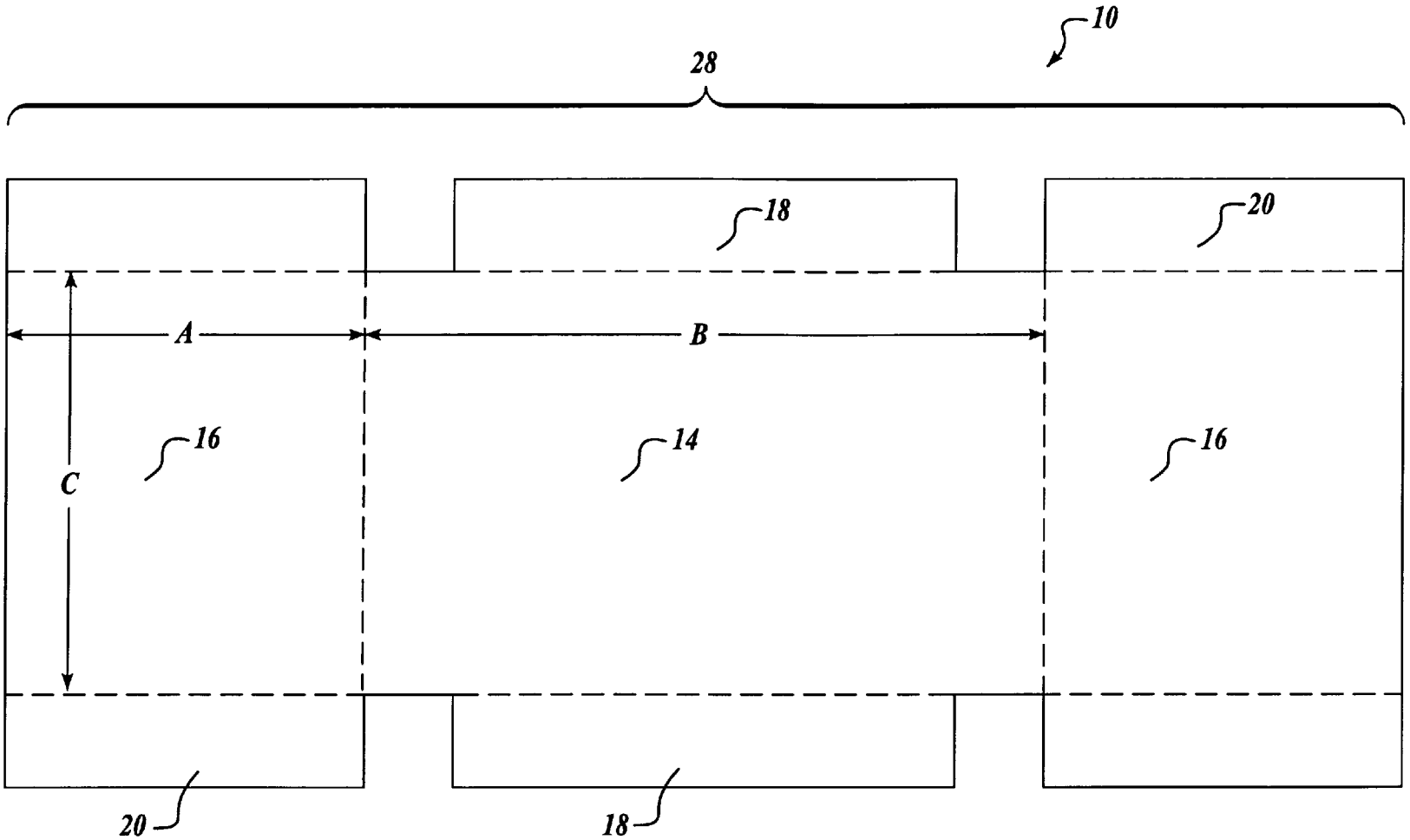
FIG. 3 is a plan view of an outer member blank used in the container of FIG. 1.

As will be appreciated from the above, the sizings of the present invention are important in order to attain the close proximity of the secondary end panels 24 of the inner members 12 when assembled. Referring to FIG. 3, one embodiment uses an outer member 10 with an end wall height A of $8\frac{11}{32}$ inches, a side wall width B of $15\frac{13}{16}$ inches, and an end wall width C of $9\frac{3}{4}$ inches. The inner member 12 of FIG. 4 includes an end wall height A' of $8\frac{3}{16}$ inches, a side wall width B' of $15\frac{9}{16}$ inches, and a secondary end wall width C' of $4\frac{9}{16}$ inches. Referring to the embodiment of FIGS. 7 and 8, its outer member 10 has an end wall height A of $9\frac{17}{32}$ inches, a side wall width B of $11\frac{5}{8}$ inches, and an end wall width C of $11\frac{5}{8}$ inches. The inner member 12 of FIG. 8 includes an end wall height A' of $9\frac{7}{16}$ inches, a side wall width B' of $11\frac{3}{8}$ inches, and a secondary end wall width C' of $5\frac{9}{16}$ inches.

The present invention container may be formed with various top lids and/or flaps. Referring to FIGS. 1–4, both the inner and outer members 12, 10 include top flaps 30 hingedly connected to their respective upper edges. Alternatively, either one or the other of the inner and outer members 12, 10 may include such flaps. In one embodiment, top flaps 30 are folded laterally and overlap for a portion. See the embodiment of FIGS. 4–8. Adhesive may be applied to the overlap area to hold these flaps closed. In another embodiment, the flaps include a tab that is folded downward and tucked into the container. In yet another embodiment, the flaps are sized simply to abut one another, with exterior tape holding them in a closed, lateral position. Alternatively, the flap may use outer flanges that either fold down around the outside of the outer member and are held via glue, tape, etc., or that are tucked into the container and held by friction.

As will be appreciated by a reading of the above, the present invention is a bliss-style container having an easily manufactured side wall formed of two single-ply members that provide improved container strength and stacking capability. By avoiding the known double wall material (i.e., such as those using two fluted mediums interspersed between three liners or the like) the present invention reduces waste and reduces production time, while still offering a wall of at least double-ply thickness.

While the preferred embodiment of the invention has been illustrated and described, it will be appreciated that various changes can be made therein without departing from the spirit and scope of the invention. For example, various glue lines may be used to form the container. In one embodiment, glue is provided between all overlapping panels. The placement of glue, in general, will vary depending on the particular application and the strength required. By way of further example, the container may be shrink wrapped for closure. As an additional example, the container may include handle holes in its side or end walls. See for example, FIG. 1.

The embodiments of the invention in which an exclusive property or privilege is claimed are defined as follows:

1. A rectangular container comprising:

(a) an outer member formed of single-ply thickness and including a lateral bottom panel, two primary end panels hingedly connected to opposed bottom panel end edges, and two reinforcing side flaps hingedly connected to opposed bottom panel side edges; each primary end panel including two upright reinforcing side flaps hingedly connected to opposed primary end panel side edges; each primary end panel including an interior surface;

(b) first and second separate inner members each formed of single-ply thickness and each of substantially the same size and configuration; each inner member including an upright side panel and first and second secondary end panels hingedly connected to opposed side edges of each side panel; each secondary end panel having an outer edge;

wherein as assembled, the inner members are located within the outer member; one reinforcing side flap and two opposed upright reinforcing side flaps forming a U-shaped side wall support along the exterior surface of each inner member upright side panel;

wherein as assembled, the first secondary end panels are located adjacent one of the primary end panel interior surfaces and the second secondary end panels are located adjacent the other primary end panel interior surfaces; both sets of secondary end panels being sized so that their outer edges are positioned within a distance of less than about 0.25 inches of one another.

2. The container of claim 1, wherein the components of the U-shaped side wall support are coplanar with one another.

3. The container of claim 1, wherein each inner member further includes a bottom flap hingedly connected to the upright side wall; as assembled, the bottom flap being adjacent the bottom panel of the outer member.

4. The container of claim 1, wherein at least one of the inner member upright side panels and secondary end panels includes a top flap hingedly connected thereto.

5. The container of claim 4, wherein each inner member upright side panel and first and second secondary end panels includes a top flap hingedly connected thereto.

6. The container of claim 4, wherein each inner member upright side panel includes a top flap hingedly connected thereto; wherein as assembled, the top flaps fold downward and overlap with one another.

7. The container of claim 1, wherein the container has an overall end wall width dimension and an overall side wall width dimension, the end wall width dimension being less than the side wall width dimension.

8. The container of claim 1, wherein the container includes a handle hole extending through a primary outer member end panel and through the adjacent inner member upright secondary end panels.

* * * * *